US006827144B2

(12) United States Patent
Nicholson

(10) Patent No.: US 6,827,144 B2
(45) Date of Patent: Dec. 7, 2004

(54) METHOD FOR REDUCING SAND PRODUCTION

(75) Inventor: Elizabeth Diane Nicholson, Coton (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 10/258,365

(22) PCT Filed: Apr. 24, 2001

(86) PCT No.: PCT/GB01/01816

§ 371 (c)(1),
(2), (4) Date: Mar. 24, 2003

(87) PCT Pub. No.: WO01/81719

PCT Pub. Date: Nov. 1, 2001

(65) Prior Publication Data

US 2003/0168216 A1 Sep. 11, 2003

(30) Foreign Application Priority Data

Apr. 26, 2000 (GB) ..... 0010107

(51) Int. Cl.[7] ..... E21B 43/11

(52) U.S. Cl. ..... 166/297; 166/250.1; 166/254.1; 166/255.1; 166/308.1

(58) Field of Search ..... 166/250.1, 250.01, 166/255.1, 297, 308.1, 254.1; 73/152.59, 152.54, 152

(56) References Cited

U.S. PATENT DOCUMENTS

| | | | | |
|---|---|---|---|---|
| 4,529,036 | A | 7/1985 | Daneshy et al. | |
| 5,040,619 | A * | 8/1991 | Jordan et al. | 175/4.51 |
| 5,318,123 | A | 6/1994 | Venditto et al. | |
| 5,360,066 | A | 11/1994 | Venditto et al. | |
| 6,283,214 | B1 * | 9/2001 | Guinot et al. | 166/297 |

FOREIGN PATENT DOCUMENTS

EP 0 602 980 A2 6/1994

OTHER PUBLICATIONS

Berghofer Auswahl der optimalen Perforationsstrecken unter Berücksichtigung der Absandungsproblematik Erdöl Erdgas Kohle, vol. 115, No. 7/8, 1999, pp. 344–348.

Ewy et al Hollow cylinder tests for studying fracture around underground openings Key questions in rock mechanics, Cundall et al (eds), Balkema, Rotterdam, 1988, pp. 67–74.

Guenot Borehole breakouts and stress fields Int. J. Rock Mech. Min. Sci. and Geomech. Abstr., vol. 26, no 3/4, 1989, pp. 185–195.

Kessler et al A simplified pseudo 3D model to evaluate sand production risk in deviated cased holes 68$^{th}$ Annual Technical Conference and Exhibition of the SPE, Houston, Texas, Oct. 3–6, 1993, SPE 26541.

Santarelli et al Optimizing the completion procedure to minimize sand production risk 66$^{th}$ Annual Technical Conference and Exhibition of the SPE, Dallas, Texas, Oct. 6–9, 1991, SPE 22797.

Tronvoll et al The effect of anisdtropic stress state on the stability of perforation cavities Int. J. Rock Mech. Min. Sci. and Geomech. Abstr., vol. 30, No. 7, 1993, pp. 1085–1089.

Vernik et al Strength anisotropy in crystalline rock: Implications for assessment of in situ stresses from wellbore breakouts Rock mechanics contributions and challenges, Hustrulid and Johnson (eds), 31$^{st}$ US Rock Mech. Symp. (Golden Col), 1990, pp. 841–848.

Wang et al Sand production potential near inclined perforated wellbores 47$^{th}$ Annual Technical Meeting of the Petroleum Society, Calgary, Alberta, Jun. 10–12, 1996, pp. 70–1 to 70–9.

Willson et al Drilling in South America: A wellbore stability approach for complex geologic conditions Latin American and Caribbean Petroleum Engineering Conference, Caracas, Venezuela, Apr. 21–23, 1999, SPE 53940.

* cited by examiner

*Primary Examiner*—David Bagnell
*Assistant Examiner*—G M. Collins
(74) *Attorney, Agent, or Firm*—Tim W. Curington; William B. Batzer; John J. Ryberg

(57) ABSTRACT

A method for optimally orienting perforations in a subterranean formation is disclosed, the optimization process being based on establishing the orientation of bedding planes in the formation and, where applicable, hole size effects while determining an orientation of the perforation that balances the stress concentration along the circumference of the cross-section between perforation and bedding plane in further improvements of the method inhomogeneous stress distributions and permeability are included into the optimization process.

4 Claims, 10 Drawing Sheets

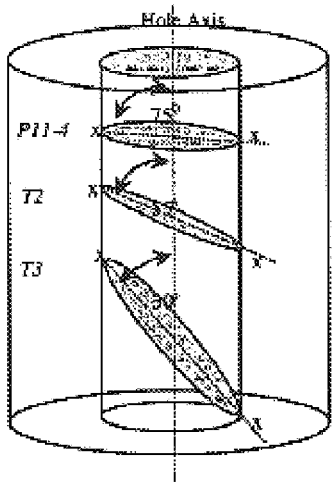
FIG. 1
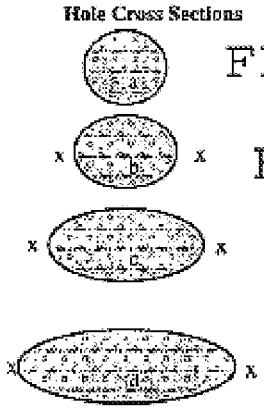
FIG. 1A
FIG. 1B
FIG. 1C
FIG. 1D
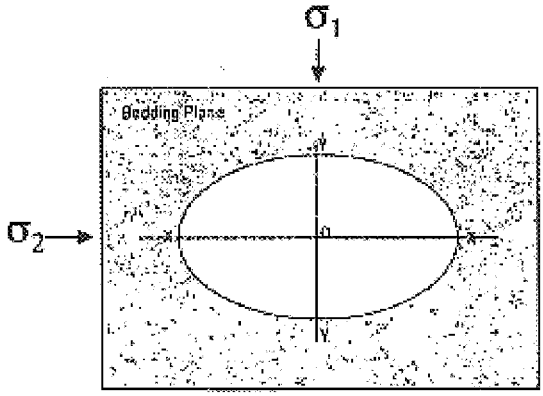
FIG. 2A
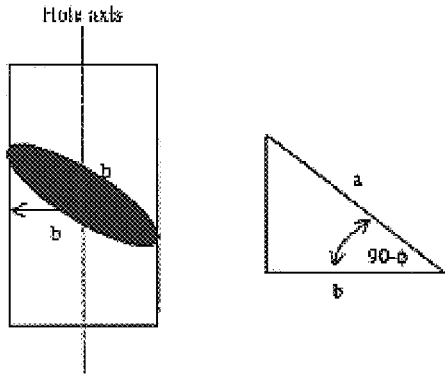
FIG. 2B

METHOD FOR REDUCING SAND PRODUCTION

The present invention relates to the field of reducing sand production during borehole drilling, perforating and hydrocarbon production. In particular, the invention relates to a method of reducing sand production from perforated sandstones with bedding layers.

BACKGROUND OF THE INVENTION

In the production of hydrocarbons from hydrocarbon-bearing unconsolidated formations, a well is provided which extends from the surface of the earth into the unconsolidated, or poorly consolidated formation. The well may be completed by employing conventional completion practices, such as running and cementing casing in the well and forming perforations through the casing and cement sheath surrounding the casing, thereby forming an open production interval which communicates with the formation.

The production of hydrocarbons from unconsolidated or poorly consolidated formations may result in the production of sand along with the hydrocarbons. Produced sand is undesirable for many reasons. It is abrasive to components within the well, such as tubing, pumps and valves, and must be removed from the produced fluid at the surface. It may partially or completely clog the well, thereby making necessary an expensive workover. In addition, the sand flowing from the formation may leave therein a cavity that may result in collapsing of the casing.

It is known and described for example in the U.S. Pat. Nos. 6,003,599, 5,443,119, or 5,360,066 to orient perforations with respect to the azimuthal direction of the maximum in-situ horizontal compressive stress. This direction within a hydrocarbon-bearing reservoir having non-uniform horizontal tectonic stresses surrounding a well is determined.

Oriented perforations are then formed in the reservoirs surrounding the well. These perforations are oriented in the azimuthal direction of the determined maximum in-situ horizontal compressive stress. Thereafter hydrocarbon production is initiated from the reservoir into the well through the perforations, whereby the potential for production of sand along with hydrocarbons produced from the reservoir is minimized due to the orientation of the perforations within the reservoir in the direction of maximum in-situ horizontal compressive stress. If the well is cased, the perforations extend through such casing and into the reservoir. In some of the above cited references, the perforation tools is oriented and orientated perforations are shot to increase the effectiveness with less regard to sanding problems but more in view of a later fracturing of the formation.

Furthermore, it is known and described for example in the U.S. Pat. No. 5,040,619 to incorporate into the design of a perforation gun a swivel connected with a cable head assembly and a navigation system for determining the instantaneous angle of the tool with respect to a vertical reference. The angle of firing of the shaped charges is adjusted at the time of installation with respect to the horizon and that in turn is correlated to the formation of interest in the well borehole which is then perforated with perforations which are parallel to the formation bedding plane.

In the '619 and other patents, perforation are oriented in direction of bedding planes within the formation. The purpose of that particular orientation is to ensure maximum permeability of the formation around the circumference of the perforation.

In view of the known art, it is seen as an object of this invention to improve the selection of an optimal orientation of a perforation with respect to the surrounding formation.

SUMMARY OF THE INVENTION

According to the invention perforations are generated in subterranean formations by a method that comprises the steps of determining the orientation of bedding planes of said formation; defining an orientation of said perforation relative to said bedding planes; determining a cross-section of a hole generated by said perforation in said bedding plane; calculating a stress concentration along the circumference of said cross-section; and repeating these steps until said stress concentration along said cross-section is homogenized.

Hence, the invention provides an optimization process according to which perforations are oriented with respect to the orientation of bedding planes. The optimization process is mainly based on homogenizing the stress concentration or tangential stress at the perimeter of the cross-section of the perforation with the bedding plane. The expression "homogenize" is understood as minimizing the difference between the largest and the smallest stress concentration along the circumference of the cross-section. It is effectively attempting the level the stress along the circumference so as to avoid peaks of stress.

However, according to a further aspect of the invention the optimization includes in addition to the mutual orientation of bedding planes and perforation further parameters. Such parameters are the stress distribution in the formation, i.e. any inhomogeneity of stress in the rock. Such deviation from what is usually referred to as hydrostatic will affect the optimal orientation of the perforation under the stress balancing criterion stated above.

Another aspect of the invention includes the use of geometrical consideration in the optimization process. The geometrical aspect includes the shape of the perforation within the bedding plane. It was found that the stability of a perforation depends inversely on its radius. Given that in many cases the perforation will generate a hole with an elliptical cross-section in the bedding plane (if it is not shot exactly perpendicular to the bedding plane), the effective radius of curvature of the hole changes from point to point. As an ellipse is highly symmetric, it might suffice to calculate the effective radius at only a small number points.

Ideally and in addition to the parameter mentioned above, the optimization process includes a criterion that relates to permeability. Hence, the optimization process, which is predominantly a stability-focussed process, may have permeability considerations imposed on it as additional constraints. As it is known that permeability is higher in direction of the bedding planes, whereas stability in an idealized case tends to be higher for a perforation perpendicular to the bedding plane, it can be easily seen that any pre-determined constraints on permeability (and hence productivity) can have a significant impact on the final optimized orientation of the perforations.

These and other features of the invention, preferred embodiments and variants thereof, possible applications and advantages will become appreciated and understood by those skilled in the art from the detailed description and drawings following below.

BRIEF DESCRIPTION OF THE DRAWINGS

FIG. 1 shows the intersection of bedding planes at different angles with a circular axial hole;

FIGS. 1A–1D show the geometry of the holes through the bedding planes of FIG. 1.

FIGS. 2A, B show the geometry of an elliptical hole through a bedding plane. (A) shows the principal stresses at $\theta=0$ ($\sigma_2$) and $\theta=90$ ($\sigma_1$) and (B) shows the relationship between the bedding angle $\phi$ and the axes of the ellipse;

DETAILED DESCRIPTION INCLUDING DRAWINGS

Figure 3:
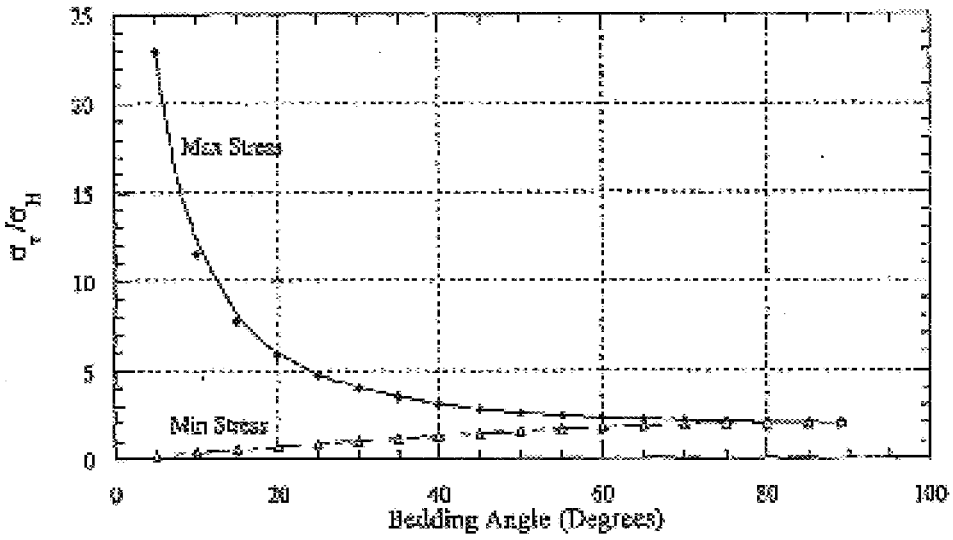
FIG. 3 shows theoretical minimum and maximum tangential stress for bedding angles 0 to 90 degrees, with respect to $\sigma_H$.

A simple initial picture for the origin of the influence of the bedding planes under hydrostatic conditions can be gained by considering the shape of the intersection of these planes with a borehole/perforation (FIG. 1). If the bedding plane is normal to the axis of the hole, the hole through each individual bedding plane will be circular (FIG. 1A), so the stress is distributed symmetrically in the absence of defects. If the sample is cut so that the bedding plane is at an angle less than 90 degrees to the hole axis (FIGS. 1B–1D), then the hole through each bedding plane becomes elliptical. This angle is referred to as the bedding angle and is the angle between the hole axis and the semi-major axis of the elliptical hole made through each bedding plane. As the bedding angle decreases, the ellipticity of the intersection increases. If each plane is considered independently, then the stress concentration at the ends of the semi-major axis increases as well, giving a greater risk of sanding there. This leads to breakout formation along the dip of the bedding. It follows that under hydrostatic conditions the least favourable orientation, in terms of strength and sanding prevention, should be where the axis of the hole is parallel to the bedding plane orientation.

The introduction of a non-hydrostatic stress state to a sample containing a circular borehole (true triaxial test) will result in a change in the stress concentration around the hole. There is likely to be competition between the stress concentration effect produced by the rock structure (bedding) and that as a result of the applied stress; the contribution from each is under investigation here.

In the following model the rock is visualised as being made up of a number of individual bedding planes stacked together, whose properties are isotropic within each plane and a circular hole through the rock is translated into elliptical holes through each plane. The stresses applied to a piece of rock in any orientation can then be transformed into stresses acting within each bedding plane. This method of describing the structure of weak sandstone is only an assumption and, as yet, has not been proved valid; it is equivalent to assuming that the bedding planes have negligible shear strength.

Assuming that the rock properties in the plane of the bedding are isotropic, the equation describing the tangential stress around an eliptical hole, through each bedding plane, is given by $$\sigma_t = \frac{2ab(\sigma_1+\sigma_2) + (\sigma_1-\sigma_2)[(a+b)^2\cos 2(\beta-\eta) - (a^2-b^2)\cos 2\beta]}{a^2+b^2-(a^2-b^2)\cos 2\eta}, \quad [1]$$

where a and b are the length of the semi-major and semi-minor axis of the ellipse respectively, $\sigma_1$ and $\sigma_2$ are the stresses across the minor and major axis respectively, $\sigma_2$ is inclined at an angle $\beta$ to the OX axis and $\sigma_1$ is inclined at an angle $90°+\beta$ (FIG. 2). $\eta$ is related to the polar angle $\theta$ ($\tan\theta=(b/a)\tan\eta$).

FIG. 2 shows the geometry of an elliptical hole through a bedding plane. (A) shows the principal stresses at $\theta=0$ ($\sigma_2$) and $\theta=90$ ($\sigma_1$) and (B) shows the relationship between the bedding angle $\phi$ and the axes of the ellipse.

Under hydrostatic conditions $\sigma_1=\sigma_2=\sigma_H$ and the equation reduces to $$\sigma_t = \frac{4ab\sigma_H}{a^2+b^2-(a^2-b^2)\cos 2\eta}. \quad [2]$$

The maximum tangential stress at X, where $\theta=0$, $\eta=0$ (FIG. 2) is $$\sigma_{t_T} = \frac{2a\sigma_H}{b}. \quad [3a]$$

The minimum tangential stress at Y, where θ=90, η=90 is $$\sigma_t = \frac{2b\sigma_H}{a}. \quad [3b]$$

FIG. 3 shows the theoretical maximum and minimum stress for bedding angles ranging from 0 to 90 degrees with respect to $\sigma_H$.

Under conditions of non-hydrostatic principal stresses, the predicted distribution of tangential stress around the elliptical hole through each bedding plane changes. Equation 1 becomes $$\sigma_t = \frac{2a\sigma_1}{b} + \sigma_1 - \sigma_2, \text{ at } X \text{ for } \theta = 0, \eta = 0, \beta = 0. \quad [4a]$$

$$\sigma_t = \frac{2b\sigma_1}{a} + \sigma_2 - \sigma_1, \text{ at } Y \text{ for } \theta = 90, \eta = 90, \beta = 0. \quad [4b]$$

Figure 4:
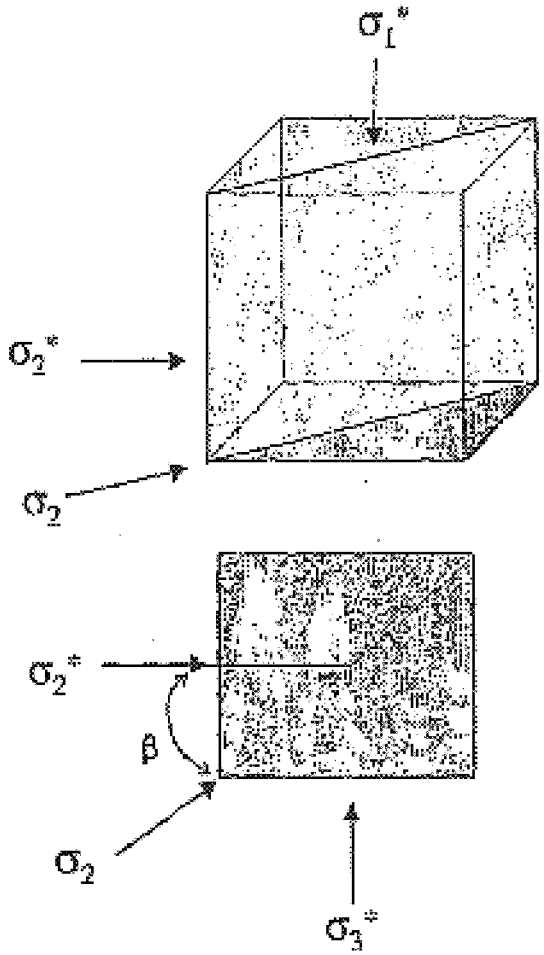
FIG. 4 shows the transformation of principal stresses in to stresses acting along the axes of a bedding plane.

These equations hold when $\sigma_1$ and $\sigma_2$ are applied along the OX and OY axes respectively. For other principal stress orientations, $\sigma_1$ and $\sigma_2$ need to be calculated. Consider the stresses acting on a cube (FIG. 4). Principal stress $\sigma_1$ * is acting along the OY axis of the bedding plane shown (therefore $\sigma_1=\sigma_1$*), but $\sigma_2$* is at an angle β from OX. The transformed stress, $\sigma_2$, acting along OX can be calculated using the following equation, $$\sigma_2=\sigma_2^*\cos^2\beta+\sigma_1^*\sin^2\beta. \quad [5]$$

For the experiments in this study only one of the principal stresses ($\sigma_2$*) required transforming.

FIG. 4 shows transformation of principal stresses in to stresses acting along the axes of a bedding plane.

The analysis above can be understood by considering the stress concentration around the hole for two different bedding angles.

Figure 5A:
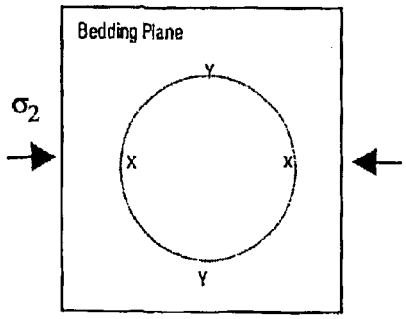
FIGS. 5A, B show cross-sections of the hole along a given bedding plane. (A) a sample with bedding angle close to 90 degrees giving a near circular hole and (B) a bedding angle of less than 90 degrees giving an elliptical hole through each bedding plane.
Figure 5B:
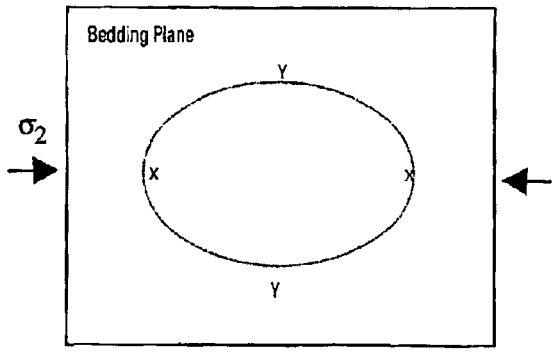

For a sample with a bedding angle close to 90 degrees (FIG. 5*a*), the theory dictates that under hydrostatic conditions, the stress around the hole made thorough each bedding plane is fairly uniform. There will be a slight stress concentration due to the bedding at positions marked X; failure/sanding will occur here first. The stress $\sigma_2$ would only need to be increased by a small amount to increase the stress levels at Y to initiate failure of the rock there. If however the bedding angle is much less than 90 degrees (FIG. 5*b*), the predicted stress concentration at X is significantly greater than that at Y. More stress would have to be applied laterally before the stress concentration at Y reaches a level to fail the rock.

FIG. 5 shows cross-sections of the hole along a given bedding plane. (A) a sample with bedding angle close to 90 degrees giving a near circular hole and (B) a bedding angle of less than 90 degrees giving an elliptical hole through each bedding plane.

In order to maximise the stability of the hole, the tangential stress around the hole should be uniform ($\sigma_t$ at X=$\sigma_t$ at Y). From equation 4

$$\sigma_t = \frac{2a\sigma_1}{b} + \sigma_1 - \sigma_2 = \frac{2b\sigma_2}{a} + \sigma_2 - \sigma_1 \quad [6a]$$

which becomes $$\frac{\sigma_2}{\sigma_1} = \frac{a}{b} \quad [6b]$$

where $\sigma_2/\sigma_1$ is the theoretical stress ratio required to ensure equal tangential stress around the hole. Using this analysis it should be possible to position perforations/boreholes so that the stress concentration produced by the bedding plane effect matches that produced by the non-hydrostatic stress state in the earth, giving them greater stability in weak zones.

In order to build a more complete picture of the failure of the hole, the hole size effect should also be included. The basis of the hole size effect is that the smaller the hole the stronger it is. For an elliptical hole, the effective strength at any point on the surface should be dependent on the radius of curvature at that point. Therefore although the elastic theory predicts a stress concentration effect due to elliptical shape of the hole at position X (FIG. 5*b*), the rock is much stronger there, due to its smaller radius of curvature. On the contrary the stress concentration at Y is low, but the larger radius of curvature at Y results in an effective strength of a fraction of that at X.

Figure 6:
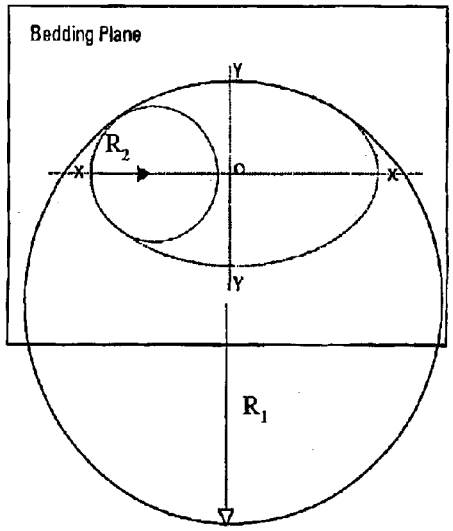
FIG. 6 shows the radius of curvature of the region around positions X and Y.
Figure 7:
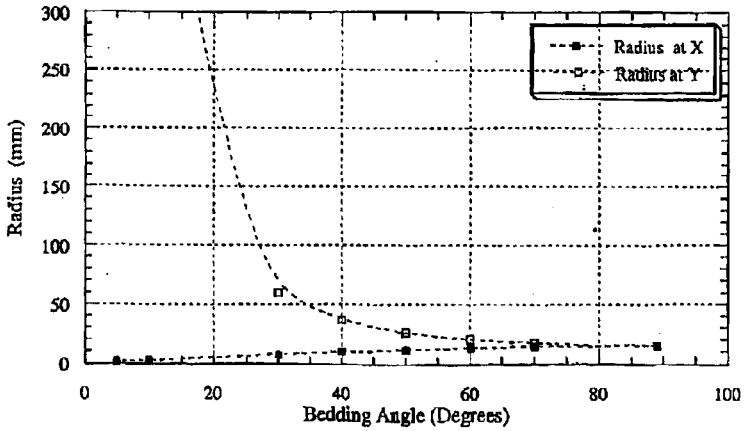
FIG. 7 shows the variation of $R_1$(at Y) and $R_2$ (at X) with bedding angle.

Consider an ellipse (FIG. 6). The radius of curvature at Y and X can be approximated to $R_1$ and $R_2$ respectively, where $R_1=a^2/b$ and $R_2=b^2/a$. The variation of $R_1$ and $R_2$ with bedding angle can be seen in FIG. 7.

Figure 8:
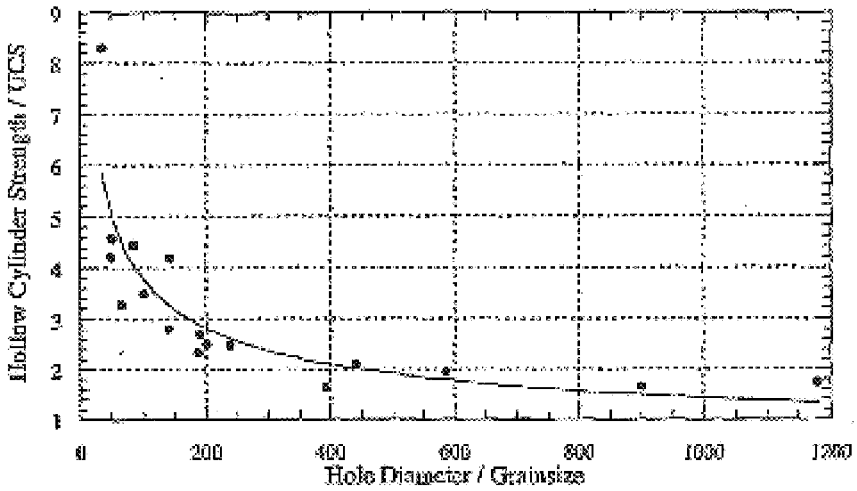
FIG. 8 shows the relationship between hole size, grain size, UCS and hollow cylinder strength.

The calculated values of $R_1$ and $R_2$ can be used to estimate the hollow cylinder strength at any position around a hole in a rock, if the grain size and the uniaxial compressive strength (USC) of the rock is known, using the data from FIG. 8.

Experimental Results

Figure 9:
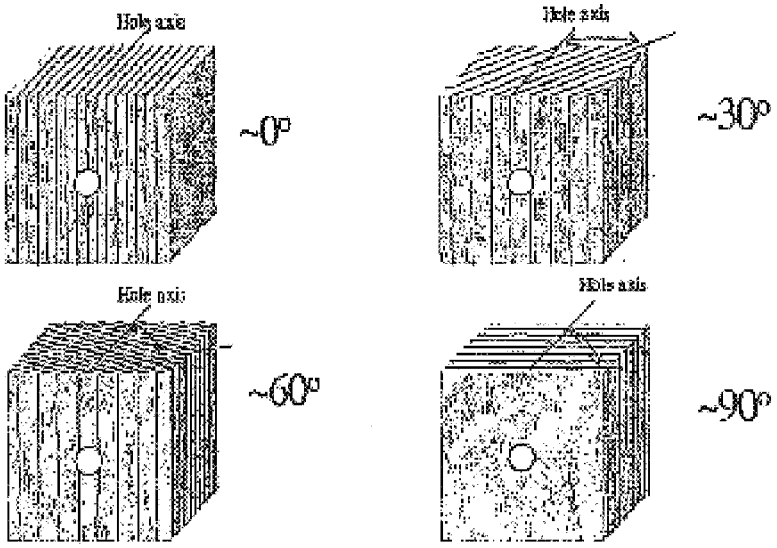
FIG. 9 shows schematically sample blocks of St Andrews sandstone with a perforation at four different angles with respect to the bedding plane.

Four blocks of St Andrews sandstone, 400 mm cube, were obtained from Dunhouse Quarries. Each was cut at a different angle to the bedding, so that an axial hole 30 mm diameter, through the centre of one set of faces, made angles of approximately 0, 30, 60 or 90 degrees with the bedding (FIG. 9).

Figure 10:
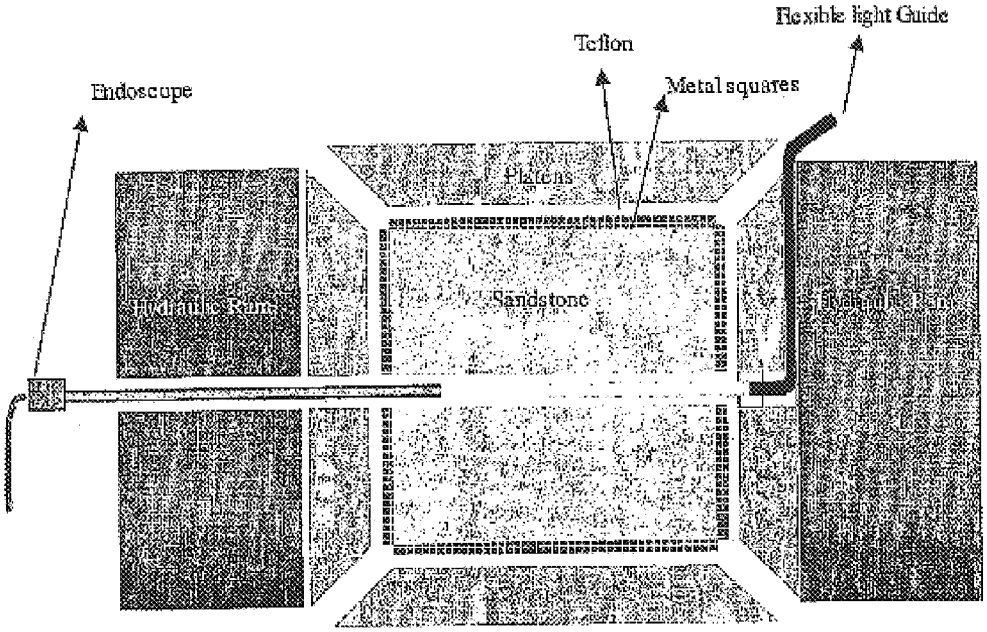
FIG. 10 shows the true triaxial tester as applied to test samples.

Each sample was prepared for true triaxial testing by gluing metal pieces (approximately 20 mm square, 3 mm thick) on to all 6 surfaces; they act to distribute the load evenly across each face (FIG. 10). A sheet of Teflon was then placed between the prepared sample and the platens of the machine to reduce any losses due to friction. Three sets of hydraulic rams produced the compressive stress in the X, Y and Z axes. Each axis could be loaded independently. The optical set up within the hole was similar to previous experiments. An opening in one platen allowed access to the axial hole through the sample. The endoscope camera was placed at one end of the hole, with the light guide at the centre. There was no through access so the light guide had to be made in two parts; a flexible section which was incorporated in to the platen and a rigid section which was connected to the flexible part through the entrance hole.

Figures 11A, 11B, 11C:
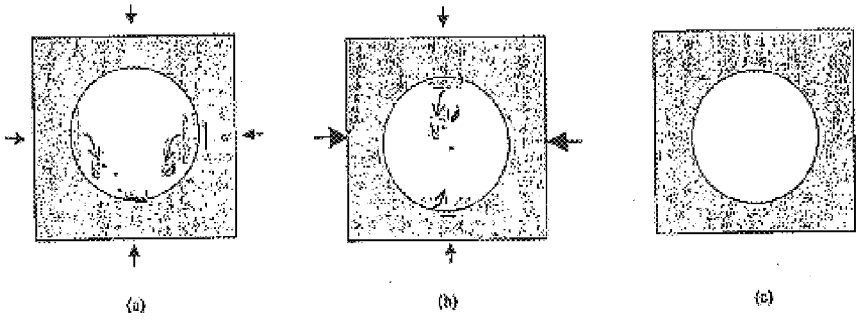
FIGS. 11A–C show (A) failure under hydrostatic pressure (B) failure due to applied differential stress and (C) breakouts as a result of the stress regime.

The testing procedure was as follows:

Stage 1: Hydrostatic pressure was applied to the samples until the first signs of failure were observed. This failure should be due to the bedding orientation only. The samples were positioned in the tester so that failure under hydrostatic conditions occurred in the horizontal positions (FIG. 11*a*). In reality small deviations in bedding planes and irregularities in the sample structure caused shifting of the failure from truly horizontal.

Stage 2: The pressure was then held steady in two directions and increased in the third (lateral direction). The application of a differential stress eventually causes failure in the vertical positions (FIG. 11*b*); the position of failure is due to the applied stress.

Figure 12:
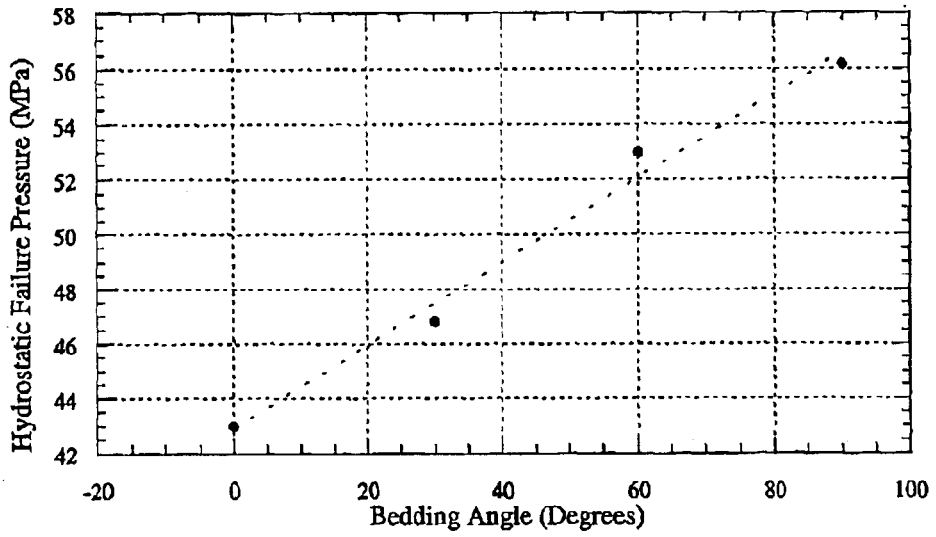
FIG. 12 shows hydrostatic failure pressure versus the bedding angle for St Andrews sandstone.

The stress difference between stage 1 and stage 2 failure should yield the contribution of the bedding planes to failure under conditions of non-hydrostatic stress. FIG. 12 shows a typical sample with two sets of breakouts, one from each stage of failure. After testing, the samples were sectioned and observations made. Various samples were taken from the blocks for uniaxial compression, and physical testing.

True Triaxial Tests

The samples failed as expected (FIG. 11). Under hydrostatic pressure the stress concentration effect of the bedding caused breakouts in the horizontal position (position X, FIG. 2). Once failure was visible, the stress was held constant in two directions and increased slowly in the third ($\sigma_2$*). As soon as $\sigma_2$* was increased, failure at X stopped i.e. the applied stress reduced the stress concentration at X to a level below that of the failure stress of the rock in that position. At the same time, the stress concentration increased in the vertical position (Y). When the failure strength of the rock at Y was reached, failure occurred producing a second set of breakouts. Table 2 shows the results of the true triaxial tests on St Andrews sandstone. The bedding angle is the angle between the hole axis and the semi-major axis of the elliptical hole made through each bedding plane. The hydrostatic failure stress is the pressure at which the rock starts to fail under hydrostatic stress conditions (Stage 1 failure). The differential stress is the difference between the hydrostatic failure stress and the non-hydrostatic failure stress, $\sigma_2$*$-\sigma_1$, (Stage 2 failure). The angle between breakouts was designed to be 90 degrees. However small deviations in the bedding planes and heterogeneities in the structure often changed the angle. In the case of the sample 4 cut at 60 degrees to the bedding, Stage 1 of the test resulted in breakouts in a non-horizontal position. On changing the stress state, the first breakout continued to sand and just changed direction; no clear distinction could be made between the two stress regimes so it was not possible to record a differential stress.

TABLE 2

Results of the true triaxial test for St Andrews sandstone.

| Sample | Bedding Angle (Degrees) | Hydrostatic Failure Stress (MPa) | Differential Stress (MPa) | Angle Between Breakouts |
|---|---|---|---|---|
| 1 | 0–5 | 43 | 24 | ~68 |
| 2 | 85–90 | 56.16 | 3 | ~83 |
| 3 | 30 | 46.8 | 12.4 | 89 |
| 4 | 60 | 53 (40.5*) | — | 0,100 |

*Failure due to defect

FIG. 12 shows the hydrostatic failure stress versus bedding angle. The results agree with previous studies on hollow cylinder tests; the increase in failure stress between the weakest orientation (bedding angle 0 degrees) and the strongest orientation (bedding angle 90 degrees) is 30%.

Figure 13:
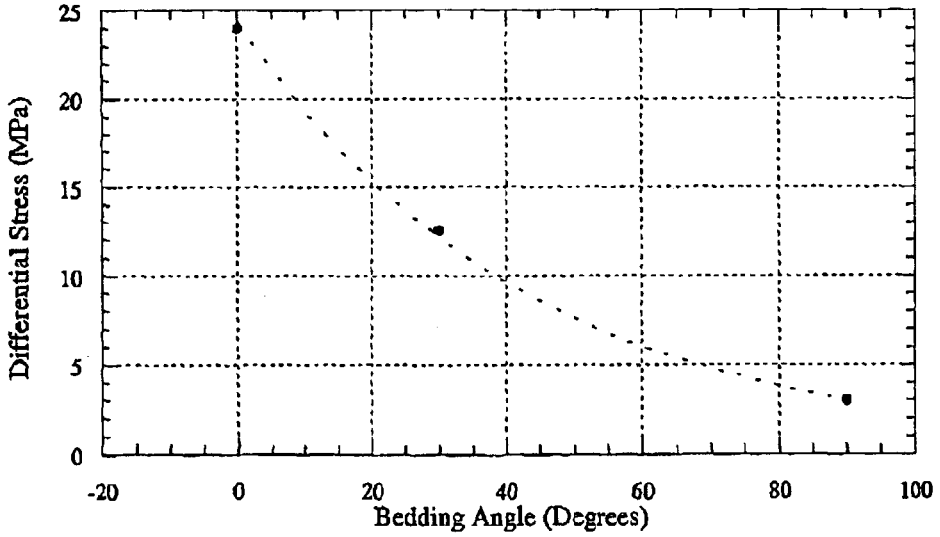
FIG. 13 shows the differential stress ($\sigma_2-\sigma_1$) versus bedding angle for St Andrews sandstone.
Figure 16A:
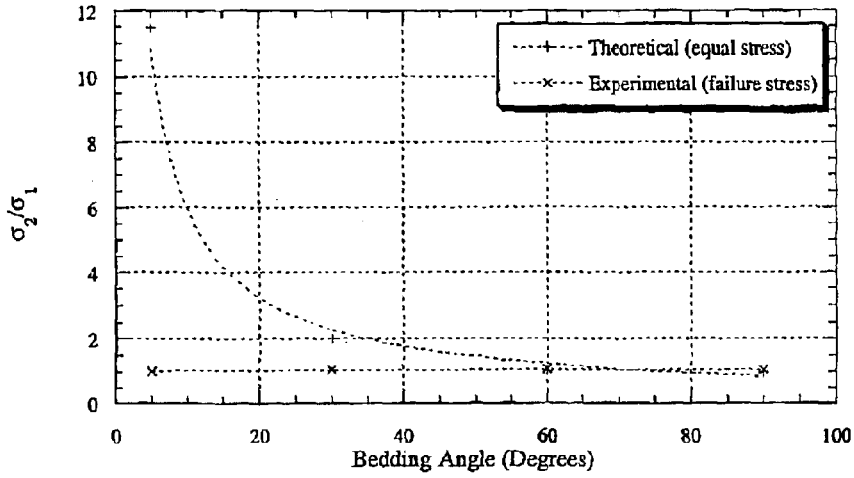
FIG. 16A shows the ratio of stresses $\sigma_2/\sigma_1$ versus the bedding angle (b) schematic of the stresses.
Figure 16B:
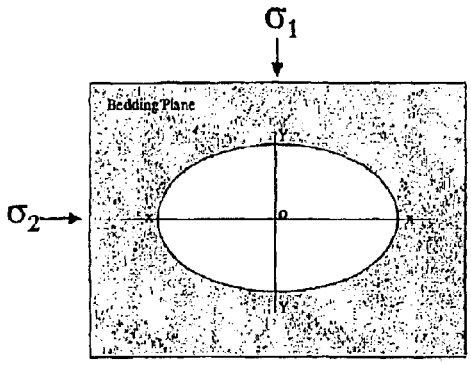
FIG. 16B is a schematic of the stresses.

FIG. 13 shows the differential stress ($\sigma_2$*$-\sigma_1$) versus the bedding angle; the differential stress increases as the bedding angle is reduced. The theory (section 2) suggests that the greater the bedding angle, the lower the ratio between the tangential stress at X and Y, and therefore the differential stress required to cause failure at Y. Also, the greater the bedding angle, the smaller the angle $\beta$ between the applied stress, $\sigma_2$*, and the OX axis of the bedding plane (FIG. 4) and hence the greater the stress $\sigma_2$ acting on each bedding plane. For bedding angles close to zero, $\sigma_2$* has very little effect on $\sigma_2$, the transformed stress; $\sigma_2$* has to be increased substantially before the stress at Y is great enough to cause failure. FIG. 16 shows behaviour in line with these expectations.

Table 3 shows the transformed stress at Stage 2 failure calculated for each sample using equation 5. For large bedding angles the transformed stress $\sigma_2$ is of similar magnitude to the applied stress $\sigma_2$*. For small bedding angles the transformed stress is closer in magnitude to $\sigma_1$.

TABLE 3

The transformed stress for each test sample.

| Bedding Angle (Degrees) | Hydrostatic Failure Stress (MPa) | Transformed Stress $\sigma_2$ (MPa) | In-plane Differential Stress (MPa) ($\sigma_2 - \sigma_1$) |
|---|---|---|---|
| 0–5 | 43 | 43.18 | 0.18231 |
| 85–90 | 56.16 | 58.99 | 2.9391 |
| 30 | 46.8 | 49.9 | 3.1 |
| 60 | 53 (40.5*) | 57.3 | 4.5 (extrapolated) |

Figure 14:
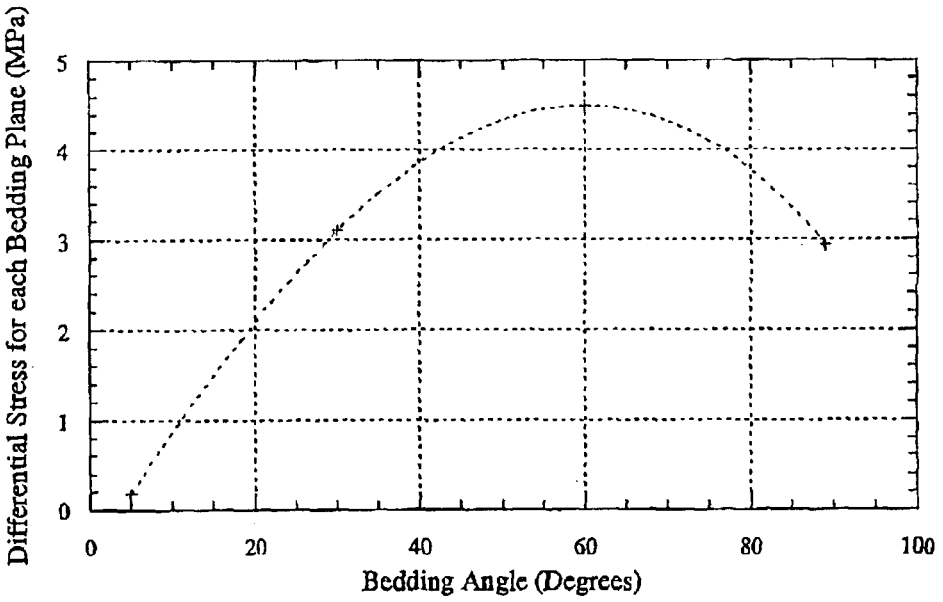
FIG. 14 shows the in-plane differential stress to cause failure versus the bedding angle for St Andrews sandstone.

FIG. 14 shows the in-plane differential stress ($\sigma_2-\sigma_1$) to cause failure versus the bedding angle, for a range of angles, extrapolated from FIG. 13. For bedding angles close to zero, the hole through each bedding plane can be visualised as an almost infinitely long and infinitely sharp ellipse. Substantial increases in the applied stress $\sigma_2$* will make only a small contribution to $\sigma_2$, the stress acting along the OX axis. In the experiments, only the slightest increase in $\sigma_2$ was required to caused failure. Theory dictates that ($\sigma_2-\sigma_1$) should be greatest for small angles as the stress concentration at Y is substantially lower that at X. The discrepancy between theory and reality can be explained by the hole size effect.

The following section compares the experimental results with the theory for the stress distribution around an elliptical hole as outlined above.

Mathematical Interpretation of Results

Figure 15:
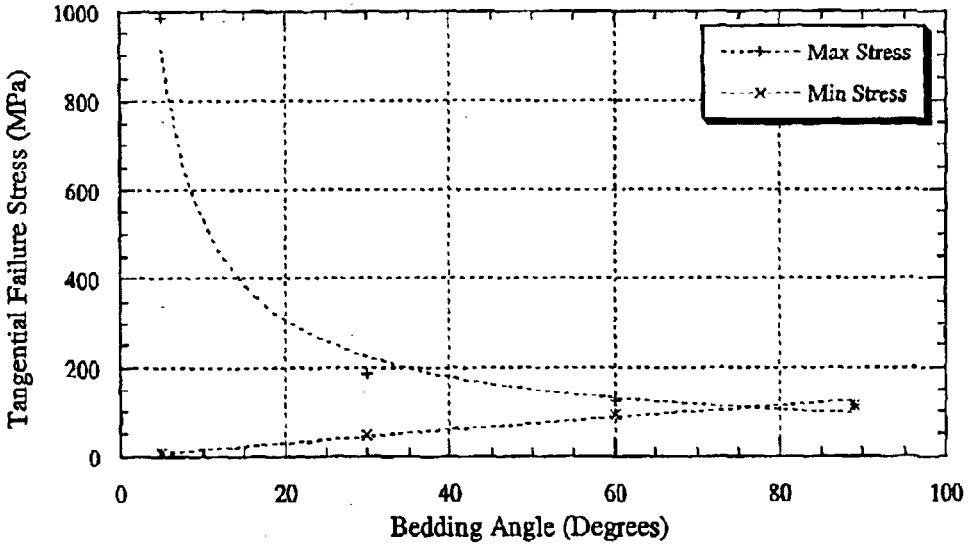
FIG. 15 shows the tangential failure stress at positions X (maximum stress) and Y (minimum stress) under hydrostatic stress conditions, versus bedding angle.

Under hydrostatic conditions (Stage 1 failure) and for bedding angles less than 90 degrees, failure occurs at position X (FIG. 2*a*) due to the elliptical nature of the hole through each bedding plane. In this case, the theoretical maximum and minimum tangential stress can be calculated using equation 3. FIG. 15 shows the results, using the failure stress data from FIG. 13.

Introducing non-hydrostatic stresses (Stage 2 failure) reduces the stress at X to a value below its failure threshold and increases the stress at Y. If $\sigma_2$ continues to increase, there will be a point at which the tangential stresses at X and Y are effectively equal. In the experimental tests, $\sigma_2$ was increased further until failure occurred at position Y. For maximum hole stability, it is necessary to even out the tangential stress. The applied stress ratio, $\sigma_2/\sigma_1$ required to ensure equal tangential stress around the hole is given by equation (6).

FIG. 16 shows the theoretical ratio for equal stresses versus the bedding angle. Also plotted is the experimental stress ratio to cause failure (Stage 2). It can be seen that the measured failure stress ratio for St Andrews sandstone is significantly less than that theoretically predicted for maximum stability (the stress ratio for failure should be greater than that for equal stress. The hole size effect can explain the discrepancy.

Figure 17:
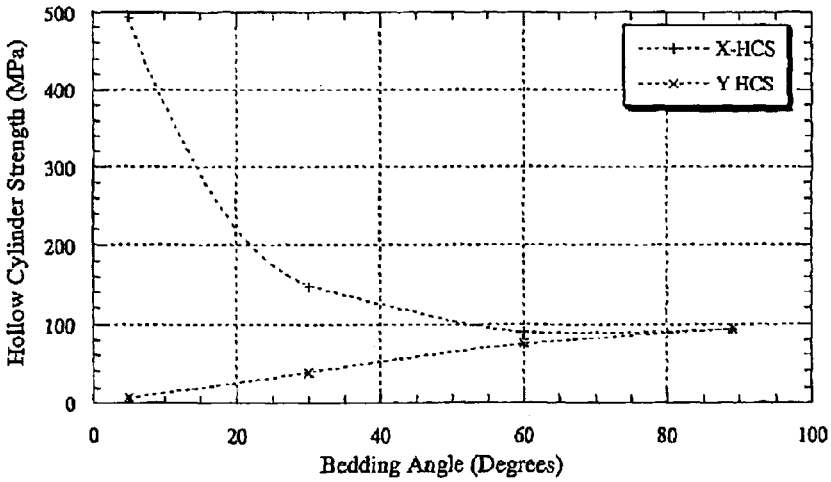
FIG. 17 shows the Hollow cylinder strength versus bedding angle for St Andrews sandstone.

Using the grain size and UCS for St Andrews sandstone at each bedding angle and the hole size effect data, the hollow cylinder strength (HCS) for each radius can be estimated (FIG. 8). The effective hollow cylinder strength at positions X and Y for all bedding angles (experimental and extrapolated) is shown in FIG. 17.

The graph shows that although the elliptical shape of the hole causes a stress concentration at position X, which may be great enough to cause failure under certain stress conditions, the effective strength (HCS) is enhanced due to the size effect. The effective strength of the rock at a given point on the ellipse depends on the radius of curvature at that point. To be able to even out the tangential stress around an elliptical hole, this strength difference must be taken in to account.

Figure 18:
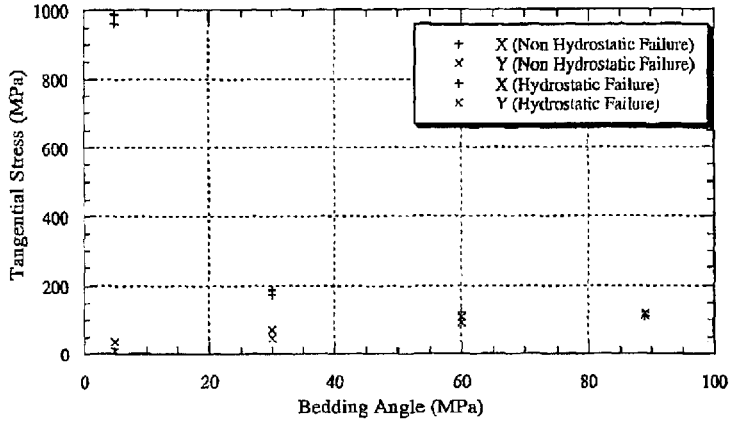
FIG. 18 shows the tangential stress to cause failure of the hole versus bedding angle for St Andrews sandstone at positions X and Y.

FIG. 18 shows the tangential failure stress of the samples under test versus the bedding angle. This is calculated for both positions X and Y under conditions of hydrostatic and non-hydrostatic stress (Stage 1 and Stage 2 failure), using equations 3 and 4. Position Y fails under lower levels of tangential stress as it has a lower effective strength than rock at position X. If the strength of the rock at both positions is taken into account, then the effect of applied stress can be better understood. This is done by multiplying the tangential stress at Y by a strength factor S, where S is equal to the ratio HCS at X: HCS at Y.

Figure 19:
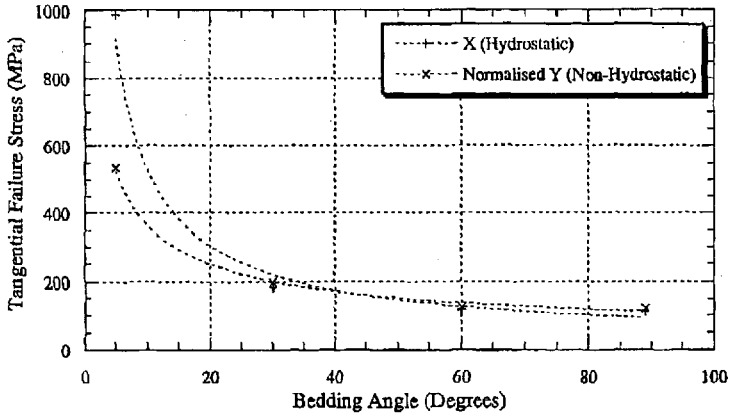
FIG. 19 shows the normalised tangential failure stress versus bedding angle for St Andrews sandstone.
Figure 20:
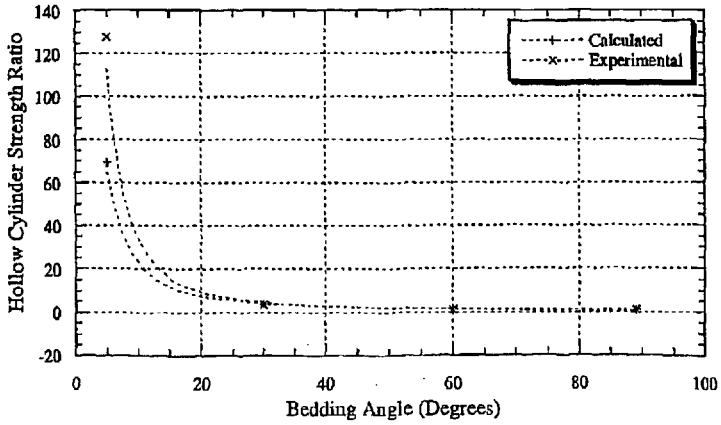
FIG. 20 shows the hollow cylinder strength ratio versus the bedding angle for St Andrews sandstone.

FIG. 19 shows the normalised data. Good agreement between Stage 1 and Stage 2 test data can be seen. FIG. 20 shows the hollow cylinder strength ratio S as a function of the bedding angle. The values calculated using the data from FIG. 8 agree well with the experimental data. The experimental values of S were used in the following analysis.

Figure 21:
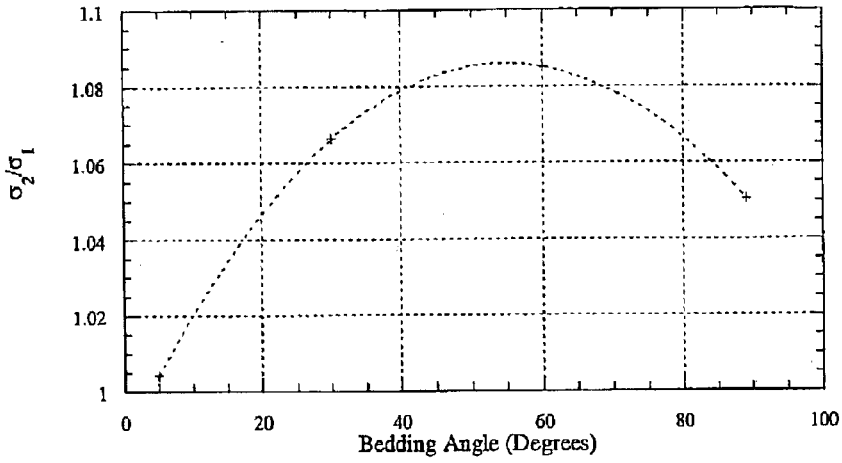
FIG. 21 shows the failure stress ratio for St Andrews sandstone versus bedding angle.

FIG. 21 shows the applied stress ratio ($\sigma_2/\sigma_1$) to cause failure versus the bedding angle. The shape of this curve can be explained in terms of the tangential stress distribution around the hole and the hole size effect. The tangential stress distribution around the hole results from the combination of the applied stresses, in this case non-hydrostatic, and the shape of the eliptical hole though each bedding plane (the bedding plane effect). The theory dictates that the applied stress ratio ($\sigma_2/\sigma_1$) should be high at small bedding angles, reducing to 1 for a bedding angle of 90 degrees; this is not the case in reality (FIG. 21).

For small bedding angles, $\sigma_2$* has little effect on $\sigma_2$, so the stress state around the hole is not far from hydrostatic. At such small angles the size effect becomes very important, as the strength at position Y is so much less than at position X, due to the almost infinite radius of curvature there. The tangential stress concentration at X (due to the elliptical shape of the hole) is only just dominant at hydrostatic pressure, and so failure occurs there. It takes a substantial increase in $\sigma_2$* to produce a minute increase in $\sigma_2$, to cause the tangential stress at Y to increase to a level that causes failure. It is the weakening of the rock due to the hole size effect that has the most influence on the failure strength. It is probable that in some rocks, under hydrostatic conditions, failure may occur at Y if the hole size effect is great enough.

As the bedding angle increases, the radius of curvature at Y decreases and so the strength of the rock increases according to the size effect; $\sigma_2$ can be increased to a higher level before failure occurs at Y. The hole size effect continues to dominate the failure behaviour of the rock, but to a lesser extent with increasing angle. The plateau in the curve begins at a bedding angle of 40 degrees, this corresponds to an axis ratio (a/b) of less than or equal to 1.55, and a hollow cylinder strength ratio(HCSx/HCSy) of less than or equal to 2.1.

For bedding angles greater than 60 degrees, the tangential stress produced by the shape of the elliptical hole (the bedding plane effect) and the applied stress $\sigma_2$, are dominant in causing failure.

From these results, three contributors to the failure of rock under true triaxial stress conditions have been identified:

1) The bedding angle; this determines the ellipticity of the hole and therefore is partially responsible for the magnitude of the tangential stress at positions X and Y.
2) The stress state; this is the second contributor to the magnitude of the tangential stress at X and Y. This may work to increase or decrease the effect of the bedding angle depending on the orientation of the maximum stress.
3) The hole size effect; the radius of curvature at any point on the surface of an elliptical hole through each bedding plane determines the effective strength of the rock at that point. This effect dominates the failure behaviour of the hole for bedding angles less than 40 degrees.

Using this information, the applied stress ratio ($\sigma_2/\sigma_1$) for greatest hole stability can be calculated for St Andrews sandstone under the conditions of the test. According to experiments and equation 4, the stress will be equal at the maximum and minimum positions around the hole when $$\sigma_\tau = \frac{2a\sigma_1}{b} + \sigma_1 - \sigma_2 = S\left(\frac{2b\sigma_2}{a} + \sigma_2 - \sigma_1\right) \quad [7]$$

where S is the hollow cylinder strength factor=$HCS_X/HCS_Y$. This reduces to $$\frac{\sigma_2}{\sigma_1} = \frac{\frac{2a}{b} + 1 + S}{\frac{2Sb}{a} + 1 + S} \quad [8]$$

FIG. 21 shows the variation of $\sigma_2/\sigma_1$ with bedding angle for failure (from experiments) and for greatest stability (equal tangential stress at X and Y).

Figure 22:
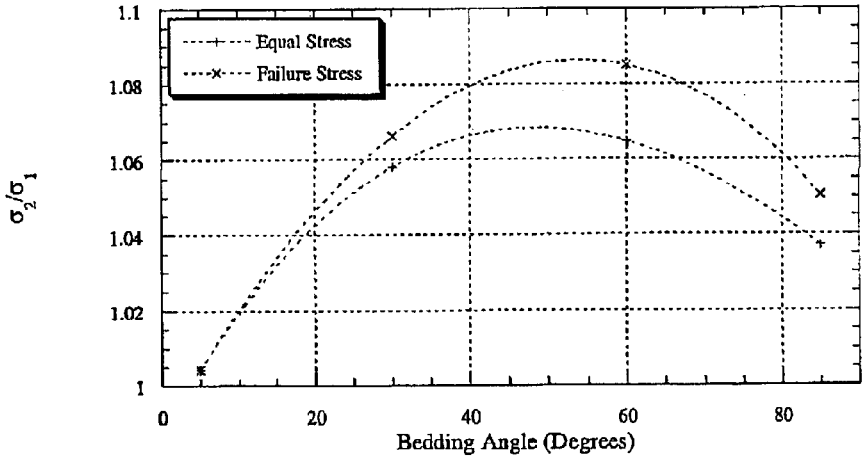
FIG. 22 shows the stress ratio $\sigma_2/\sigma_1$ to maximise the stability of the hole (equal stress data) versus bedding angle, for St Andrews sandstone.

FIG. 22 shows the stress ratio $\sigma_2/\sigma_1$ to maximise the stability of the hole (equal stress data) versus bedding angle, for St Andrews sandstone.

It is possible to determine the bedding angle for greatest stability for any sandstone, under conditions of known principal stresses ($\sigma_2$,$\sigma_1$) and borehole radius (b), as follows: From FIG. 8

$$\frac{HCS}{UCS} = \alpha(D_h/D_g)^{-n} \quad [9]$$

where $D_h$ is the diameter of the borehole/perforation, $D_g$ is the grain diameter, $\alpha$=26.826 and n=0.425. Using this equation, the hollow cylinder strength ratio can be written as $$S = \frac{HCS_x}{HCS_y} = \frac{(2R_2/D_g)^{-n}}{(2R_1/D_g)^{-n}} \quad [10]$$

On substituting $R_1=a^2/b$ and $R_2=b^2/a$ equation (10) becomes $$S=(a/b)^{3n}=(1/\sin\phi)^{1.275} \quad [11]$$

Substituting equation (11) into equation (8) yields an expression that can be solved for bedding angle $\phi$, $$\left(\frac{\sigma_2}{\sigma_1} - 1\right)(\sin\phi)^{1.275} + \frac{2\sigma_2}{\sigma_1}\sin\phi - 2(\sin\phi)^{0.275} + \frac{\sigma_2}{\sigma_1} - 1 = 0. \quad [12]$$

This expression only requires knowledge of the magnitude and direction of the principal stresses to determine the optimum bedding angle for greatest stability.

Figure 23:
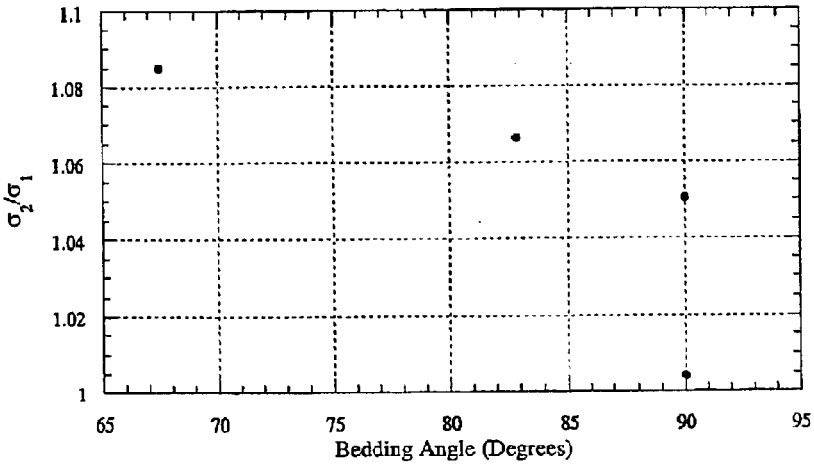
FIG. 23 shows the bedding angles generated from the $\sigma_2/\sigma_1$ failure ratios for St Andrews sandstone.

FIG. 23 shows the bedding angles generated from the $\sigma_2/\sigma_1$ failure ratios for St Andrews sandstone. The prediction is reasonable. For $\sigma_2/\sigma_1$ approximately equal to 1, the most stable bedding angle is 90 degrees. As the stress ratio increases, the bedding angle decreases i.e. the ellipticity of the hole increases to compensate for the increased stress $\sigma_2$. The accuracy of this theory is limited by the fit to FIG. 19 that determines the value of n in equation 9.

Refinement of equations (8) and (11) above is required to define limits for the magnitude and direction of $\sigma_1$ and $\sigma_2$.

For a situation downhole, where depletion is an issue, the perforations could be positioned to allow for increased stress due to depletion, thereby incorporating a time effect into the completion design.

Another effect that may be taken into account in a production scenario is permeability versus stability. Hence, attempts to maximize production from a perforation may well lead to a orientation of the perforation different from those calculated solely based on the above description. It is therefore understood that an optimal orientation may be determined on the basis of the above stability criteria and the direction of maximum permeability to provide a multidimensional optimization criterion.

What is claimed is:

1. A method of generating perforations in subterranean formations, comprising the steps of a) determining the orientation of bedding planes of said formation;

b) defining an orientation of said perforation relative to said bedding planes;

c) determining a cross-section of a hole generated by said perforation in said bedding plane;

d) calculating a stress concentration along the circumference of said cross-section;

e) repeating steps b)–d) until said stress concentration along said cross-section is homogenized to a predetermined degree of accuracy; and f) calculating an effective radius of the cross-section at at least two points.

2. The method of claim 1 comprising the further step of determining stresses in the formation and wherein the step of calculating the stress concentration along the circumference comprises the use of said formation stresses.

3. The method of claim 1 comprising the further step of determining permeability of the formation and wherein an optimal orientation of the perforation is calculated based on a balance of stress concentration along said circumference of the cross-section and maximum permeability.

4. The method of claim 1, further comprising the steps of generating perforations having the determined orientation.

* * * * *